US007044178B1

(12) United States Patent
Campbell

(10) Patent No.: US 7,044,178 B1
(45) Date of Patent: May 16, 2006

(54) TOOL STORAGE AND WORKBENCH ASSEMBLY

(76) Inventor: Terry D. Campbell, 3007 Windsor La., Janesville, WI (US) 53546

( * ) Notice: Subject to any disclaimer, the term of this patent is extended or adjusted under 35 U.S.C. 154(b) by 0 days.

(21) Appl. No.: 10/939,443

(22) Filed: Sep. 14, 2004

(51) Int. Cl.
*B25H 1/12* (2006.01)
*B25H 1/00* (2006.01)

(52) U.S. Cl. ..... 144/285; 144/286.5; 312/245

(58) Field of Classification Search ..... 144/285, 144/286.1, 286.5, 287; 108/42, 47; 312/242, 312/245, 313, 315
See application file for complete search history.

(56) References Cited

U.S. PATENT DOCUMENTS

| | | | | |
|---|---|---|---|---|
| D272,111 | S | 1/1984 | Anzalone | |
| 4,976,450 | A * | 12/1990 | Ellefson | 280/79.11 |
| 5,224,531 | A | 7/1993 | Blohm | |
| 5,383,977 | A | 1/1995 | Pearce | |
| 5,513,574 | A * | 5/1996 | Collins | 108/36 |
| 5,558,418 | A * | 9/1996 | Lambright et al. | 312/321.5 |
| 5,725,037 | A | 3/1998 | Faulhaber | |
| 6,086,073 | A | 7/2000 | Tisbo et al. | |
| 6,113,202 | A * | 9/2000 | Germano | 312/245 |
| D466,717 | S | 12/2002 | Cho | |
| 2002/0180318 | A1 * | 12/2002 | Bitner et al. | 312/200 |

* cited by examiner

*Primary Examiner*—Derris H. Banks
*Assistant Examiner*—Shelley Self

(57) ABSTRACT

A tool storage and workbench assembly includes a housing that has a back wall and a peripheral wall that is attached to and extends away from the back wall. The peripheral wall includes a bottom wall, an upper wall, a first side wall and a second side wall. The back wall has a plurality of bores extending therein. A table is hingedly coupled to the bottom wall. The table is selectively positioned in a stored position extending upwardly from the bottom wall and located within the housing or in an extended position extending outwardly away from the back wall. A first door is hingedly coupled to the first side wall and a second door is hingedly coupled to the second side wall. The first and second doors are each selectively positionable in a closed position or in an open position.

14 Claims, 3 Drawing Sheets

TOOL STORAGE AND WORKBENCH ASSEMBLY

BACKGROUND OF THE INVENTION

1. Field of the Invention

The present invention relates to bench and storage combination devices and more particularly pertains to a new bench and storage combination device for holding a plurality of tools while also providing a workbench as needed.

2. Description of the Prior Art

The use of bench and storage combination devices is known in the prior art. U.S. Pat. No. 5,725,037 describes a mobile toolbox having an integrated workbench. Another type of bench and storage combination device is U.S. Pat. No. 5,224,531 which again includes a combination mobile toolbox and workbench combination. Yet another such device is found in U.S. Pat. No. 6,086,073.

While these devices fulfill their respective, particular objectives and requirements, the need remains for a device that combines tool storage and a workbench in an assembly which may be positioned on a wall and which does not occupy a large amount of space when the device is not in use. In particular, the device, when mounted on a wall and not in use, should not extend outwardly from the wall more than 12 inches. This will provide storage and work space without using valuable space.

SUMMARY OF THE INVENTION

The present invention meets the needs presented above by generally comprising a housing that has a back wall and a peripheral wall that is attached to and extends away from the back wall. The peripheral wall includes a bottom wall, an upper wall, a first side wall and a second side wall. The back wall has a plurality of bores extending therein. A table has a back edge, a front edge and a pair of lateral edges. The back edge is hingedly coupled to the bottom wall. The table is selectively positioned in a stored position extending upwardly from the bottom wall and located within the housing or in an extended position extending outwardly away from the back wall. A first door is hingedly coupled to the first side wall and a second door is hingedly coupled to the second side wall. The first and second doors are each selectively positionable in a closed position extending over the housing and abutting the upper and bottom walls or in an open position extending outwardly away from the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
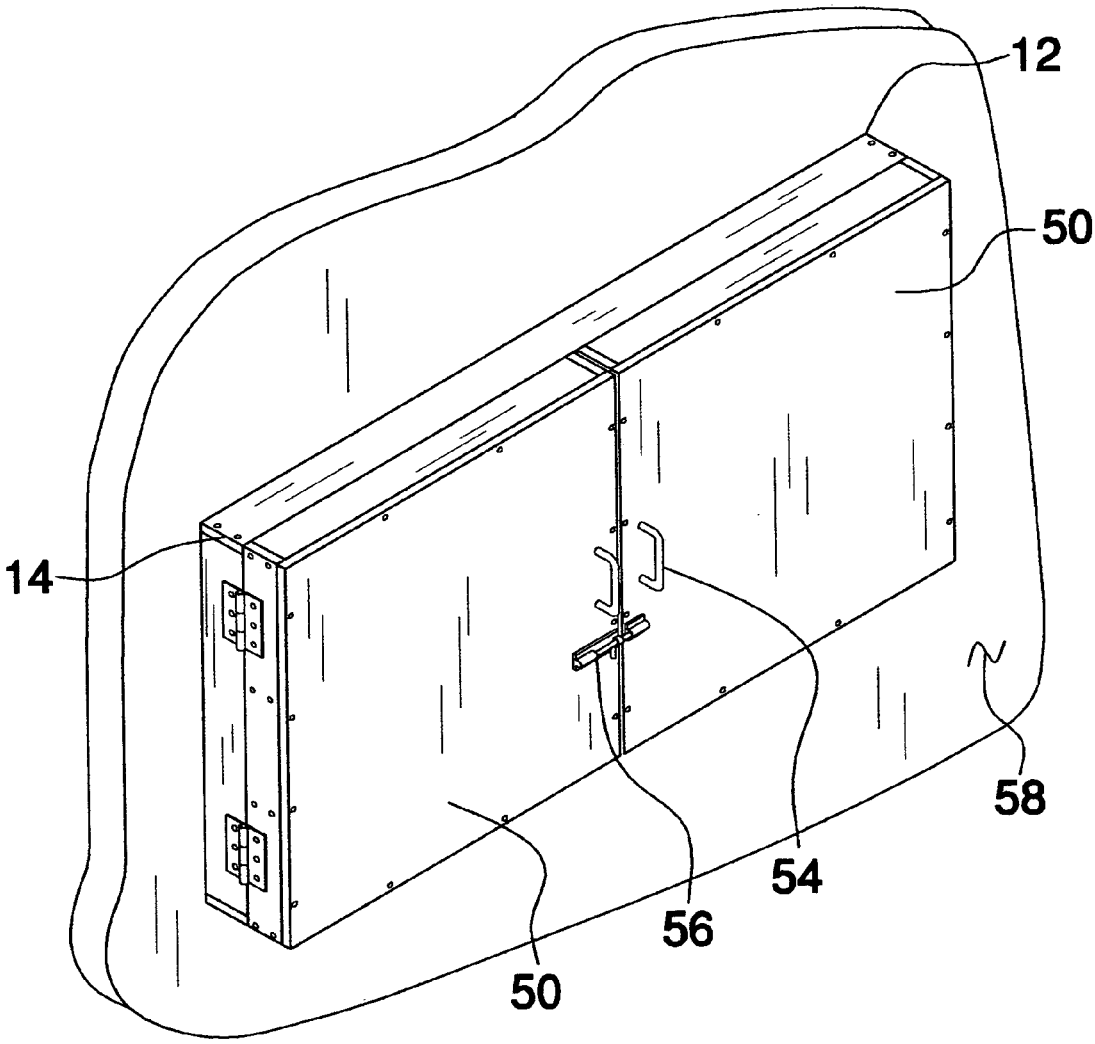
FIG. 1 is a perspective view of a tool storage and workbench assembly according to the present invention.
Figure 2:
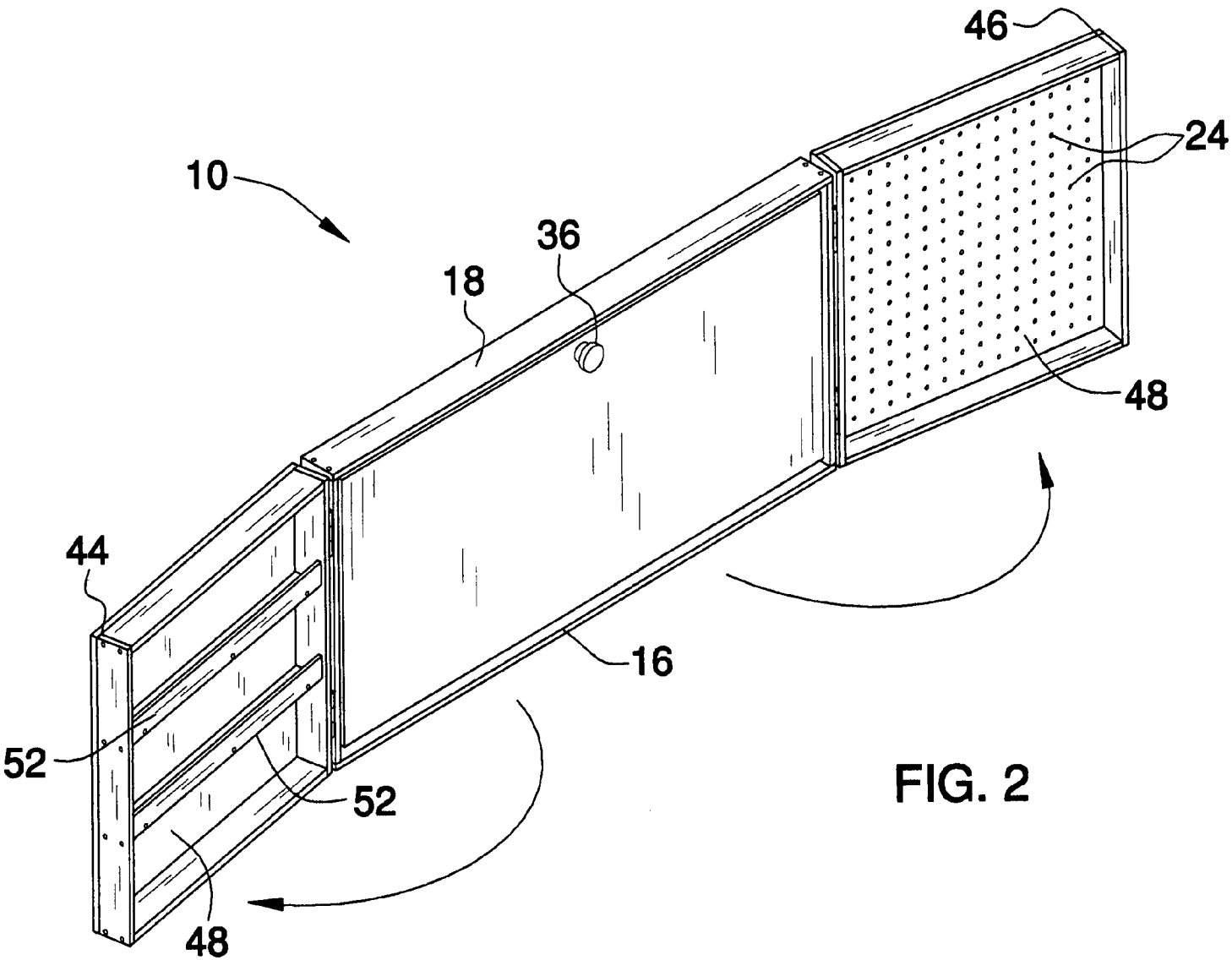
FIG. 2 is a perspective view of the present invention.
Figure 3:
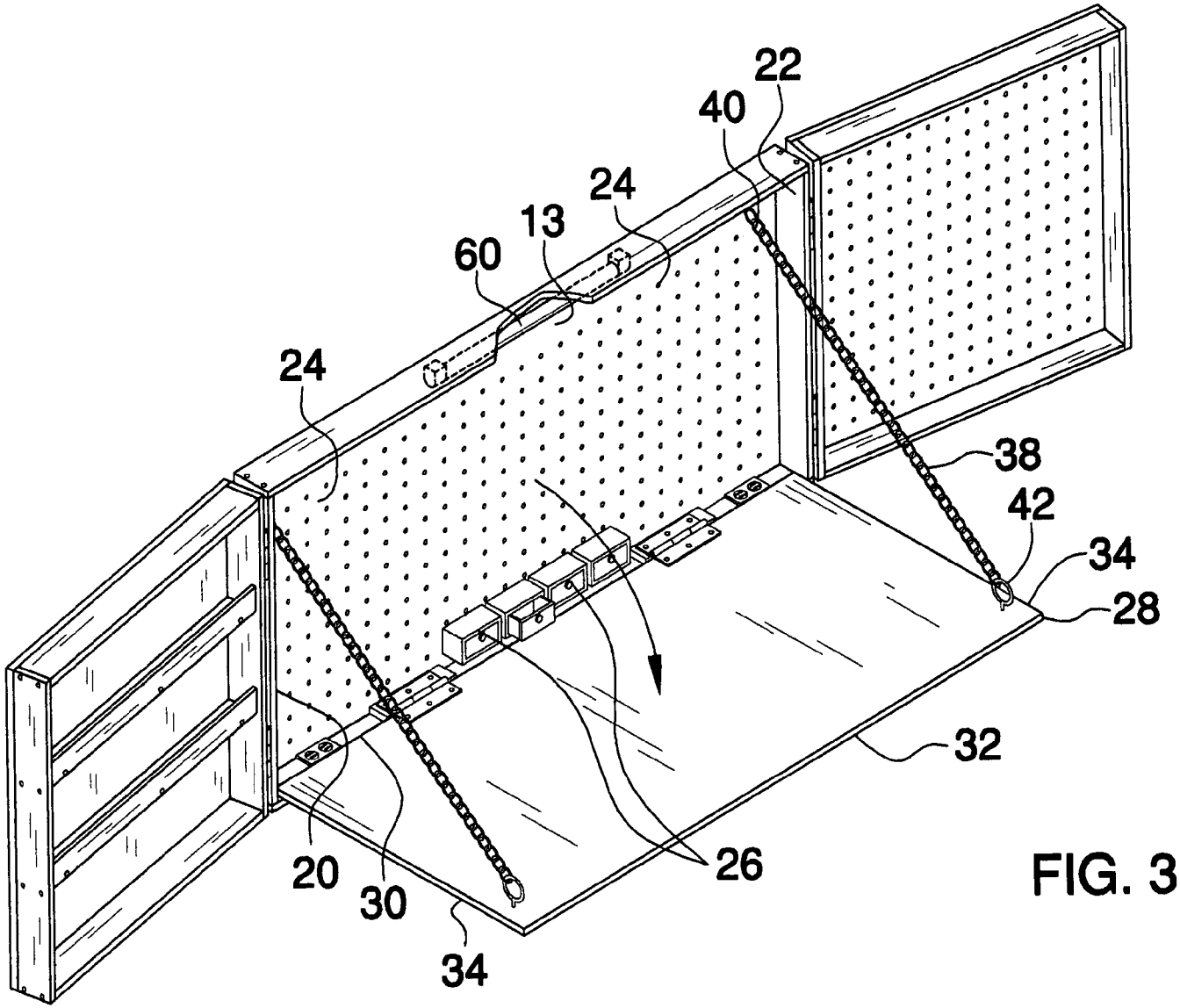
FIG. 3 is a perspective view of the present invention.

With reference now to the drawings, and in particular to FIGS. 1 through 3 thereof, a new bench and storage combination device embodying the principles and concepts of the present invention and generally designated by the reference numeral 10 will be described.

As best illustrated in FIGS. 1 through 3, the tool storage and workbench assembly 10 generally comprises a housing 12 that has a back wall 13 and a peripheral wall 14 that is attached to and extends away from the back wall 13. The peripheral wall 14 includes a bottom wall 16, an upper wall 18, a first side wall 20 and a second side wall 22. The peripheral wall 14 has depth less than eight inches and preferably equal to about 6 inches. The housing 12 has a height greater than eighteen inches and a length greater than three feet. The back wall 13 has a plurality of bores 24 extending therein. Hooks may be selectively mounted in the bores 24 for holding tools and the like. A plurality of drawers 26 is mounted on the back wall 13 and each is positioned generally adjacent to the bottom wall 16. The drawers 26 each have a depth less than a depth of the peripheral wall 4. A light emitter 60 is mounted on the housing 12. The light emitter 60 of conventional construction is positioned on the upper wall 18 and is directed toward the bottom wall 16.

A table 28 has a back edge 30, a front edge 32 and a pair of lateral edges 34. The back edge 30 is hingedly coupled to the bottom wall 16. The table 28 is selectively positioned in a stored position extending upwardly from the bottom wall 16 and located within the housing 12 or in an extended position extending outwardly away from the back wall 13. A gripping member 36 is attached to a bottom surface of the table 28 and is positioned adjacent to the front edge 32. The gripping member 36 aids in removing the table 28 from the housing 12. It is preferred that the table 28 has an outer perimeter of the same size and shape as an inner perimeter of the peripheral wall 14 and that the table 28 is frictionally held in the stored position buy the peripheral wall 14. A pair of tethers 38 each has a first end 40 and a second end 42. Each of the first ends 40 is attached to the housing 12. Each of the second ends 42 is attached to the table 28. The tethers 38 each have a length for preventing the table 28 from forming an angle with the back wall which is greater than 90 degrees.

A first door 44 and a second door 46 are provided. The first door 44 is hingedly coupled to the first side wall 20 and the second door 46 is hingedly coupled to the second side wall 22. The first 44 and second 46 doors are each selectively positionable in a closed position extending over the housing 12 and abutting the upper 18 and bottom 16 walls or in an open position extending outwardly away from the housing 12. The first 44 and second 46 doors substantially cover the back wall 13 when the first 44 and second 46 doors are in the closed position. Each of the doors 44, 46 has an inner surface 48 and an outer surface 50 with respect to the housing 12 when the first 44 and second 46 doors are in the closed position. A plurality of shelves 52 is mounted on the inner surface 48 of the first door 44. The inner surface 48 of the second door 46 has a plurality of bores 24 extending therein for the receiving of hooks. Each of a pair of handles 54 is attached to the outer surface 50 of one of the first 44 and second 46 doors.

A locking assembly 56 is attached to the outer surface 50 of the first 44 and second 46 doors for selectively securing the first 44 and second 46 doors in the closed position. The lock assembly 56 may include any conventional lock.

In use, the back wall 13 is attached to a vertical surface 58, such as the wall of a garage. Tools may be held on hooks placed in the bores 24 while a plurality of fasteners and other items may be positioned in the drawers 26 and on the shelves 52. When a workbench is required, the table 28 is lowered to its extended position as shown in FIG. 3. When the table 28 is in its stored position, the relatively short depth of the assembly 10 ensures that it will require a small amount of space when not in use.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A workbench and tool holding combination device, said device comprising:

a housing having a back wall and a peripheral wall being attached to and extending away from said back wall, said peripheral wall including a bottom wall, an upper wall, a first side wall and a second side wall, said back wall having a plurality of bores extending therein;

a plurality of drawers being mounted on said back wall and being positioned generally adjacent to said bottom wall, said drawers each having a depth less than a depth of said peripheral wall;

a table having a back edge, a front edge and a pair of lateral edges, said back edge being hingedly coupled to said bottom wall, said table being selectively positioned in a stored position extending upwardly from said bottom wall and located within said housing or in an extended position extending outwardly away from said back wall; and a first door and a second door, said first door being hingedly coupled to said first side wall and said second door being hingedly coupled to said second side wall, said first and second doors each being selectively positioned in a closed position extending over said housing and abutting said upper and bottom walls or in an open position extending outwardly away from said housing.

2. The combination device according to claim 1, wherein said peripheral wall has depth less than eight inches, said housing having a height greater than eighteen inches and a length greater than three feet.

3. The combination device according to claim 1, further including a gripping member being attached to a bottom surface of said table and being positioned adjacent to said front edge.

4. The combination device according to claim 2, wherein each of said doors has an inner surface and an outer surface with respect to said housing when said first and second doors are in said closed position, a plurality of shelves being mounted on said inner surface of said first door, said inner surface of said second door having a plurality of bores extending therein.

5. The combination device according to claim 4, further including a pair of handles, each of said handles being attached to the outer surface of one of said first and second doors.

6. The combination device according to claim 4, further including a locking assembly being attached to said outer surface of said first and second doors for selectively securing said first and second doors in said closed position.

7. The combination device according to claim 1, wherein each of said doors has an inner surface and an outer surface with respect to said housing when sail first and second doors are in said closed position, a plurality of shelves being mounted on said inner surface of said first door, said inner surface of said second door having a plurality of bores extending therein.

8. The combination device according to claim 7, further including a pair of handles, each of said handles being attached to the outer surface of one of said first and second doors.

9. The combination device according to claim 8, further including a locking assembly being attached to said outer surface of said first and second doors for selectively securing said first and second doors in said closed position.

10. The combination device according to claim 1, further including a light emitter being mounted on said housing, said light emitter being positioned on said upper wall and being directed toward said bottom wall.

11. The combination device according to claim 5, further including a light emitter being mounted on said housing, said light emitter being positioned on said upper wall and being directed toward said bottom wall.

12. The combination device according to claim 1, further including a pair of tethers each having a first end and a second end, each of said first ends being attached to said housing, each of said second ends being attached to said table, each of said tethers having a length for preventing said table from forming an angle with said back wall which is greater than 90 degrees.

13. The combination device according to claim 4, further including a pair of tethers each having a first end and a second end, each of said first ends being attached to said housing, each of said second ends being attached to said table, each of said tethers having a length for preventing said table from forming an angle with said back wall which is greater than 90 degrees.

14. A workbench and tool holding combination device, said device comprising:

a housing having a back wall and a peripheral wall being attached to and extending away from said back wall, said peripheral wall including a bottom wall, an upper wall, a first side wall and a second side wall, said peripheral wall having depth less than eight inches, said housing having a height greater than eighteen inches and a length greater than three feet, said hack wall having a plurality of bores extending therein;

a plurality of drawers being mounted on said back wall and being positioned generally adjacent to said bottom wall, said drawers each having a depth less than a depth of said peripheral wall;

a table having a back edge, a front edge and a pair of lateral edges, said back edge being hingedly coupled to said bottom wall, said table being selectively positioned in a stored position extending upwardly from said bottom wall and located within said housing or in an extended position extending outwardly away from said back wall, a gripping member being attached to a bottom surface of said table and being positioned adjacent to said front edge;

a first door and a second door, said first door being hingedly coupled to said first side wall and said second door being hingedly coupled to said second side wall, said first and second doors each being selectively positioned in a closed position extending over said housing and abutting said upper and bottom walls or in an open position extending outwardly away from said housing, said first and second doors substantially covering said back wall when said first and second doors are in said closed position, each of said doors having an inner surface and an outer surface with respect to said housing when said first and second doors are in said closed position, a plurality of shelves being mounted on said inner surface of said first door, said inner surface of said second door having a plurality of bores extending therein;

a pair of handles, each of said handles being attached to the outer surface of one of said first and second doors;

a locking assembly being attached to said outer surface of said first and second doors for selectively securing said first and second doors in said closed position;

a light emitter being mounted on said housing, said light emitter being positioned on said upper wall and being directed toward said bottom wall; and a pair of tethers each having a first end and a second end, each of said first ends being attached to said housing, each of said second ends being attached to said table, each of said tethers having a length for preventing said table from forming an angle with said hack wall which is greater than 90 degrees.

* * * * *